US005291704A

United States Patent [19]

Savorani

[11] Patent Number: 5,291,704

[45] Date of Patent: Mar. 8, 1994

[54] MODULAR CONSTRUCTION JOIST MADE UP OF A HIGH-STRENGTH PLASTIC MATERIAL, PARTICULARLY SUITABLE FOR REALIZING GRIDS, AND CLOSURE MEMBERS SUBJECTED TO PEDESTRIAN AND VEHICLE TRAFFIC

[75] Inventor: Sandra Savorani, Forli', Italy

[73] Assignee: EDIL Plast S.R.L., Farli, Italy

[21] Appl. No.: 776,765

[22] Filed: Oct. 18, 1991

[30] Foreign Application Priority Data

Oct. 18, 1990 [IT] Italy ..... 15164/90[U]

[51] Int. Cl.[5] ..... E04F 11/16

[52] U.S. Cl. ..... 52/177; 52/668; 52/650.3; 52/223.9

[58] Field of Search ..... 52/643, 664, 650.3, 52/764, 483, 593, 177, 666, 667, 668, 729, 579, 594, 227, 223.7, 223.9; 404/17, 41, 43; 14/3, 6, 17

[56] References Cited

U.S. PATENT DOCUMENTS

| | | | |
|---|---|---|---|
| 1,891,597 | 12/1932 | Jagdmann | 52/223.7 |
| 3,046,852 | 7/1962 | Graham . | |
| 3,141,531 | 7/1964 | Montgomery | 52/643 X |
| 3,307,317 | 3/1967 | Lynn | 52/667 |
| 4,522,009 | 6/1985 | Fingerson | 52/177 X |
| 5,024,550 | 6/1991 | Mainville | 52/668 X |

FOREIGN PATENT DOCUMENTS

| | | | |
|---|---|---|---|
| 8402731 | 7/1984 | European Pat. Off. . | |
| 3004290 | 8/1981 | Fed. Rep. of Germany . | |
| 722224 | 1/1955 | United Kingdom | 52/666 |
| 2099893 | 12/1982 | United Kingdom . | |

*Primary Examiner*—Carl D. Friedman
*Assistant Examiner*—Lan C. Mai
*Attorney, Agent, or Firm*—Stevens, Davis, Miller & Mosher

[57] ABSTRACT

This invention relates to a modular construction joint made up of a high-strength, composite plastic material, possibly embedding a glass fiber or similar filling material, said joist being suitable for realizing grid-like and closure members which can stand the traffic of pedestrians and vehicles.

18 Claims, 3 Drawing Sheets

MODULAR CONSTRUCTION JOIST MADE UP OF A HIGH-STRENGTH PLASTIC MATERIAL, PARTICULARLY SUITABLE FOR REALIZING GRIDS, AND CLOSURE MEMBERS SUBJECTED TO PEDESTRIAN AND VEHICLE TRAFFIC

This invention relates to a modular construction joist made up of a high-strength composite plastic material, for realizing grids and closure members capable of supporting pedestrian and vehicle traffic.

The characteristics of the joist in question as well as the advantages deriving therefrom will be evident from the following disclosure with reference to the figures of the two enclosed sheets, wherein:

FIGS. 1, 2 and 3 illustrate one embodiment of intermediate joist respectively as a side view, as a top plan view and as a bottom plan view;

FIG. 2*a* illustrates the top plane view of a second embodiment of intermediate joist;

The joist according to the present invention is realized with any suitable plastic material having a very high mechanical strength and is injectable into a mold, for instance polypropylene or Nylon in which a glass fibre and/or any other suitable filling material has been embedded.

Figure 1:
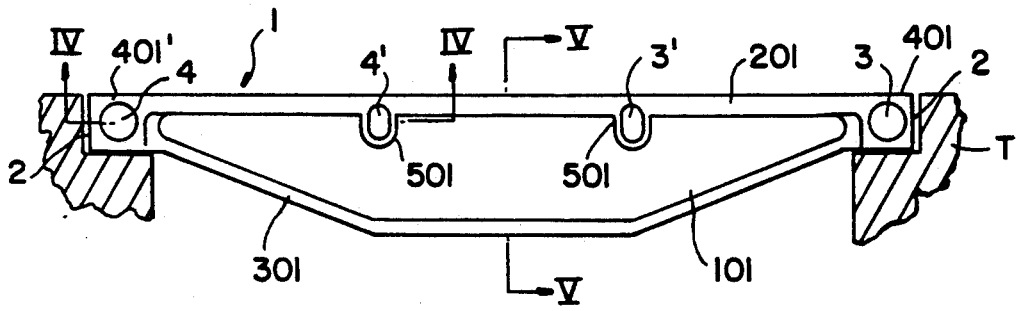
Figure 5:
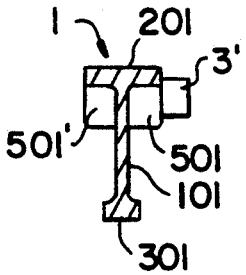

It can be seen from the figures that the modular joist 1 dealt with in the present invention has side parts in the shape of an isosceles trapezium (FIG. 1) whose major basis is in the top portion, while the cross-section is substantially in the shape of a double T (FIG. 5). It is to be understood that the isosceles trapezium shape can also be substituted with an equivalent shape, as for instance a circle sector shape, with the chord at the top position.

As it is clearly pointed out, the body of the joist having a thin thickness as for instance a thickness of a few millimeters, is designated by the numeral 101. The numeral 201 designates the upper stringer that realizes the portion in view of said joist, whereas the numeral 301 designates the lower stringer which is of less width with respect to the upper stringer.

The length of said joist is preferably a multiple of the width of a stringer 201, so that it is possible to form also square-shaped structures employing a composition of a number of joists of the type mentioned herein.

The end supports 401—401' of the joist are in the shape of a rectangular base parallelepiped, and they are of the same width as that of the upper stringer 201 and are aligned with the same.

The numeral 2 shows some small vertical ribs which are integral with the front walls of the supports

401—401', which ensure a correct spacing of the same from the support frame T, with the aim of making it easier to insert and to remove the whole structure made up of the joists, onto and from the respective frame T, as well as for aesthetical reasons.

The raised portions 501 and 501' which are integral with the upper stringer 301 and are contained within the width of the same are provided on the body 101 laterally, on both sides, according to a symmetrical and counterposed arrangement. The number of such raised portions is to change according to the length of the joist. The complementary parts are obtained in recessed and in raised portions on the walls of the supports 401—401' and of the raised parts 501—501', which are arranged on ideal planes parallel to the body 101, said complementary portions being necessary for realizing the coupling of the joists in question with each other, said joists being all arranged in parallel directions, one by the sides of the other, in contact with each other and all coplanar with the stringers 201.

The numerals 3 and 3' show pins obtained as raised portions respectively on the supports 401—401' and on the intermediate raised portions 501—501'. The pins 3 are for instance of circular cross-sections, whereas pins 3' are ellipsoidal in section and vertically oriented along their major dimension. The seats 4—4' are counterposed to said pins, such seats being suitable to receive the pins themselves so as to realize a fixed joint, such seats in addition having sides and shapes which are complementary to those of said pins and suitable to such aim. The pins 3—3' and the seats 4—4' are staggered to one other so as to allow a coupling between said joists to be realized, which is very strong and capable of resisting any kind of mechanical stress, with any orientation with respect to the joists themselves.

The seats 4—4' have such a depth as not to interfere with the ideal extension of the body 101 of said joist, in order not to jeopardize the mechanical strength of said joist.

For illustration purposes only the sizes are reported herein of a joist of the type in question, in proportion to its length. Length: 300 mm; width of the stringer 201: 25 mm; width of the lower stringer 301: 13 mm; height, or distance between the parallel sides of the body 101: 50 mm; height of the supports 401—401': 20 mm; width of the recessed portions 5 (see further in the text): 6 mm.

Figure 7:
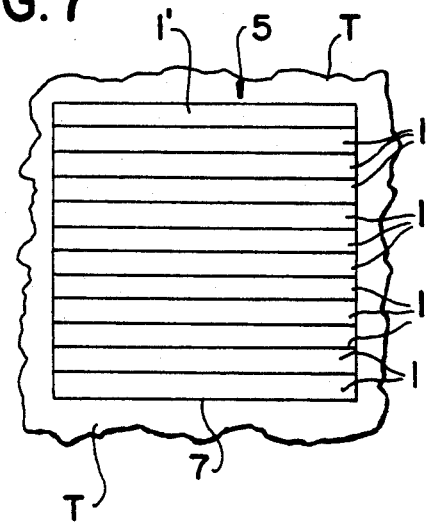
FIGS. 6 and 7 illustrate schematically and as a plan views, some examples of grids and closure members which can be realized employing the joists according to the present invention.

In FIG. 7, S shows the structure of a closure member made up of a set of some joists of the type mentioned above, which is useful for instance for the realization of a manhole cover.

Figure 2:
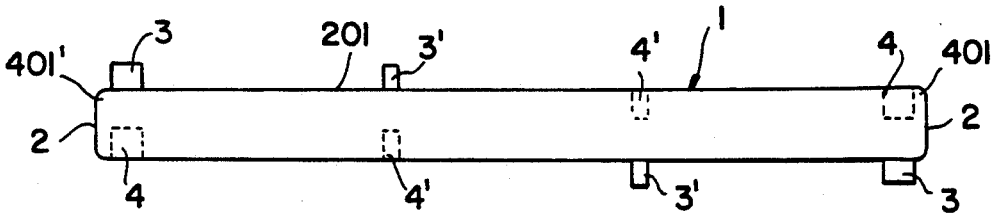
Figure 2A:
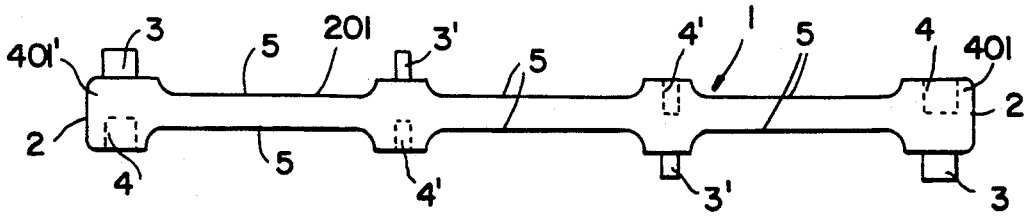
Figure 3:
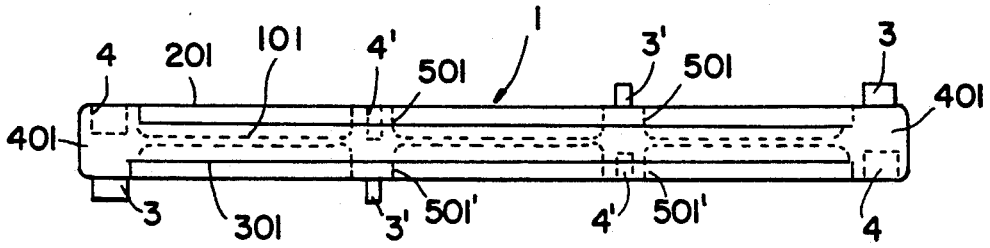
Figure 4:
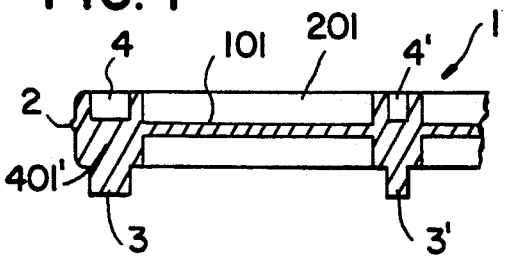
FIGS. 4 and 5 illustrate similarly the details of the joist respectively along the cross-sectional lines IV—IV and V—V of FIG. 1.
Figure 6:
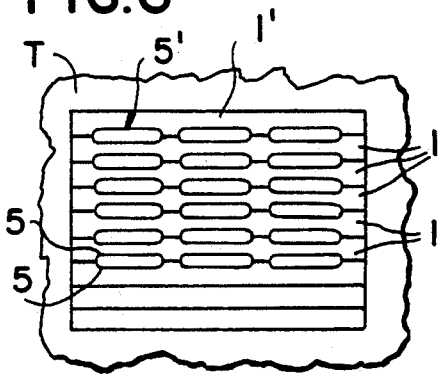

Dowels can be housed as raised members within the mold in which the joist in question is formed, said dowels giving rise to a number of recessed portions 5 on the sides of the upper stringer 201, as shown in FIG. 2*a*, which are symmetrically arranged between the supports 401—401' and the raised portions 501—501', and having such a shape that the structure S' made up of the composition of a number of joists so modified, turns out to be provided at the top portion with grid opening 5' having rounded ends, as shown in FIG. 6.

Figure 8:
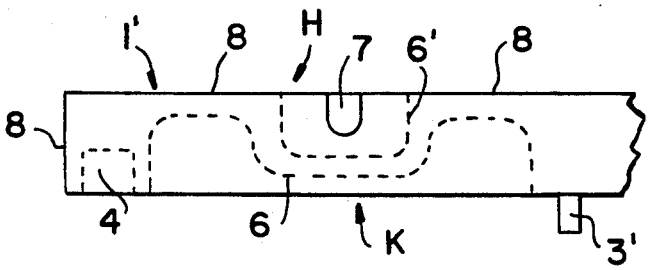
FIGS. 8 and 9 illustrate as top views a length of a joist to be placed at the ends of said closure member or of the grid which is made up of a number of joists of the kind in question.
Figure 9:
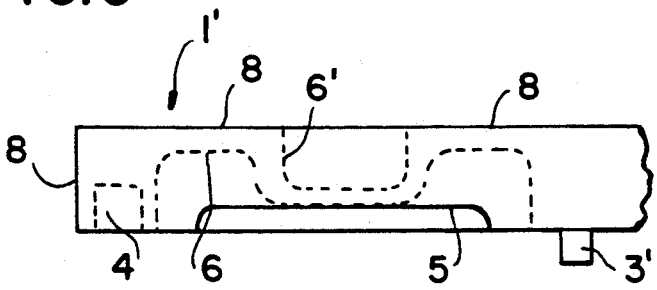
Figure 10:
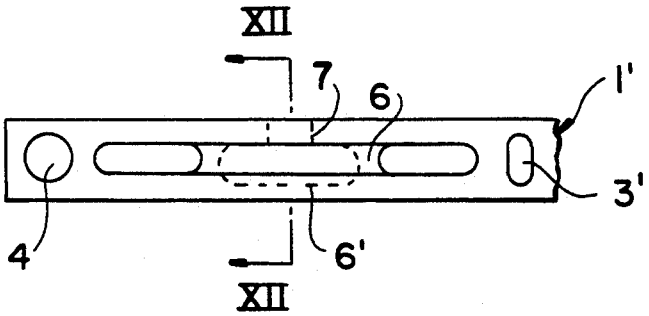
FIGS. 10 and 11 illustrate the joist length of FIG. 8 as a side view from the opposite fronts which are shown respectively by the arrows K and H.
Figure 11:
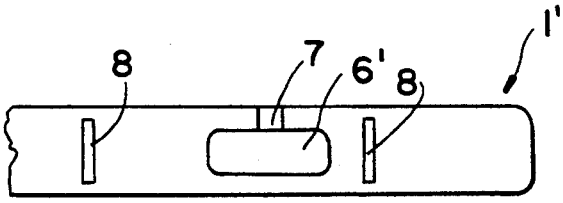
Figure 12:
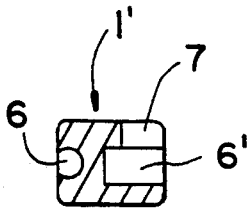
FIG. 12 illustrates a detail as observed along the cross-sectional line XII—XII of FIG. 10.

With reference now to FIGS. 8-9-10-11-12, it can be observed that the joist 1' at the ends with the structures S and S' of the type shown in FIGS. 7 and 8, are made up of members in the shape of parallelepipeds having a continuous transverse cross sections equal to those of the supports 401—401' of the joists 1 and provided with seats 4—4' as well as with pins 3—3' just on the side intended for being coupled with the joists 1. On this same side, the joists 1' are provided with the recessed portions 6 having a sinusoidal or fretted shape, which become integrated with the corresponding recesses 6' provided in the opposite side of the joist. The joists 1', when are intended for the grid-like structure S' shown in FIG. 6, are provided at least on the upper wall that defines the recesses 6 with lateral recesses 5, which are complementary to the homonimous recesses of the nearby joist 1 (FIG. 9). On the contrary, the joists 1' when are intended for closed structures S of the type illustrated in FIG. 7, are provided at least on the upper wall of one of the recesses 6', with a recessed portion 7 (FIGS. 8-11-12) suitable to allow the introduction into the corresponding recessed part 6' to be realized of a hook for hoisting the structure S so as to remove the same from the respective supporting frame T.

FIGS. 8-12, the number 8 designates some ribs vertically arranged on the sides of the joist 1' facing the frame T, in a way similar to what has been set forth for the front ribs 2 of the joists 1.

It is to be understood that the modular construction joist disclosed above can be changed by introducing all those small modifications that are capable of giving similar usefulness and adopt the same innovative conception, without departing from the spirit and scope of the invention which has been disclosed, illustrated and claimed as follows.

In the following claims, references in parentheses are with the object of making it easier to read the claims themselves and are not to be interpreted in a limitative way as regards the priority right scope of the claims themselves.

I claim:

1. A modular construction plastic filler-containing intermediate joist, comprising a body (101) with two ends having a lateral portion in the shape of an isosceles trapezium or of a circle sector whose straight-line edge is turned upwardly, an upper stringer (201) on an upper edge of said body (101), a lower stringer (301) on a lower edge of said body (101), a cross-section of said body (101), upper stringer (201) and lower stringer (301) being in the shape of a double T with the lower stringer (301) of a width less than a width of said upper stringer (201), a first and second parallelepipedal support (401,401') on each end of said body (101), said first and second supports (401,401') having a width equal to said width of said upper stringer (201), first and second symmetrically arranged raised portions (500,501') extending from said body (101) and downwardly from said upper stringer (201), pins (3,3') extending from a side of each of said first and second supports (401,401') and first and second raised portions (501,501'), conjugated seat (4,4') defined on a side of each of said first and second supports (401,401') and each of said first and second raised portions (501,501'), each of said first and second supports (401,401') and first and second raised portions (501,501') has an opposing pin and seat.

2. The joist of claim 1 wherein, the seats (4,4') that house the pins (3,3') for realizing the connection of the joists to one another, do not go beyond the ideal extension of the body (101).

3. The joist of claim 1, wherein the pin and seat of said first support are on sides opposite to the sides carrying the pin and seat of said second support and the pin and seat of said first raised portion are on a side opposite to the side carrying the pin and seat of said second raised portion in order that adjacent joists may fit together.

4. The joist of claim 1 wherein the pins (3) and the seats (4) arranged on supports (401,401') have a circular cross-section and the intermediate pins (3') and seats (4') have cross sections of a substantially elliptical shape, the major dimensions thereof being upwards.

5. The joist of claim 1 having small vertical ribs (2) on said supports (401,401') facing a support frame when in position to act as spacers.

6. The joist of claim 1, having recessed portions on the sides of the upper stringer (201) arranged symmetrically between the supports (401,401') and appending portions (501,501'), to form a whole structure so when assembled from a plurality of said joists define grid openings (5) whose ends are rounded.

7. The intermediate joist of claim 1 fitted with an end joist having a parallelepipedal shape (1') of the same width as that of the intermediate joist and pins (3,3') and seats (4,4') positioned on a single side to be coupled with said intermediate joist and laterally counterposed recessed portions (6,6') which are realized in order to render the joist lighter.

8. The joists of claim 7 wherein said end joist has slots (7) in a top portion through which hooks can be inserted into the underlying recessed portions (6').

9. The joists of claim 7 wherein said end joist has small vertical ribs (8) on a side opposite to the side having pins (3,3') and seats (4,4').

10. The joists of claim 7 wherein said end joist has on the side facing the intermediate joist recessed portions (5) which are complimentary to those provided on said intermediate joist.

11. The grid comprising a plurality of intermediate joists and two end joists, an intermediate joist comprising a an isosceles trapezium or of a circle sector whose straight-line edge is turned upwardly, an upper stringer (201) on an upper edge of said body (101), a lower stringer (301) on a lower edge of said body (101), a cross-section of said body (101), upper stringer (201) and lower stringer (301) being in the shape of a double T with the lower stringer (301) of a width less than a width of said upper stringer (201), a first and second parallelepipedal support (401,401') on each end of said body (101), said first and second supports (401,401') having a width equal to said width of said upper stringer (201), first and second symmetrically arranged raised portions (500,501') extending from said body (101) and downwardly from said upper stringer (201), pins (3,3') extending from a side of each of said first and second supports (401,401') and first and second raised portions (501,501'), conjugated seat (4,4') defined on a side of each of said first and second supports (401, 401') and each of said first and second raised portions (501,501'), each of said first and second supports (401,401') and first and second raised portions (501,501') has an opposing pin and seat and an end joist having a parallelepipedal shape (1') of the same width as that of one of the intermediate joists and pins (3,3') and seats (4,4') positioned on a single side to be coupled with an intermediate joist and laterally counterposed recessed portions (6,6') which are realized in order to render said end joists lighter.

12. The grid of claim 11, wherein the seats (4,4') that house the pins (3,3') for realizing the connection of the intermediate joists to one another, do not go beyond the ideal extension of the body (101).

13. The grid of claim 11, wherein the pin and seat of said first support are on sides opposite to the sides carrying the pin and seat of said second support and the pin and seat of said first raised portion are on a side opposite to the side carrying the pin and seat of said second raised portion in order that adjacent intermediate joists may fit together.

14. The grid of claim 11 wherein the pins (3) and the seats (4) arranged on supports (401,401') have a circular cross-section and the intermediate pins (3') and seat (4') have cross sections of a substantially elliptical shape, the major dimensions thereof being upwards.

15. The grid of claim 11 having small vertical ribs (2) on said supports (401,401') facing a support frame when in position to act as spacers.

16. The end joist of claim 11 having slots (7) in a top portion of said end joist through which hooks can be inserted into the underlying recessed portions (6').

17. The grid of claim 11 having small vertical ribs (2) on an end joist on a side opposite to the side having pins (3,3') and seats (4,4').

18. The grid of claim 11 having on the side of an end joist facing the intermediate joist raised portions (5) which are complementary to those provided on said intermediate joists.

* * * * *